United States Patent [19]

deBin

[11] Patent Number: 4,693,701

[45] Date of Patent: Sep. 15, 1987

[54] TWIN WICKETING BAG MACHINE

[75] Inventor: René F. deBin, Aalst, Belgium

[73] Assignee: FMC Corporation, Chicago, Ill.

[21] Appl. No.: 816,692

[22] Filed: Jan. 6, 1986

Related U.S. Application Data

[63] Continuation of Ser. No. 528,926, Sep. 2, 1983, abandoned.

[51] Int. Cl.[4] ..... B31B 23/14; B21B 1/98

[52] U.S. Cl. ..... 493/204; 83/171; 83/278; 83/678; 493/196; 493/198; 493/227; 493/372; 493/920

[58] Field of Search ..... 493/203, 204, 193–197, 493/226, 227, 200, 199, 926, 230, 228, 242, 238, 363, 372, 341, 470; 156/515, 510; 83/171, 278, 255, 280, 95, 639, 678, 459

[56] References Cited

U.S. PATENT DOCUMENTS

| | | | |
|---|---|---|---|
| 3,136,193 | 6/1964 | Gantz | 83/639 |
| 3,590,695 | 7/1971 | Gerard | 83/678 |
| 3,739,965 | 6/1973 | Jespersen et al. | 83/678 |
| 3,835,754 | 9/1974 | Lewyckyj | 83/678 |
| 4,018,116 | 4/1977 | Treffner et al. | 83/171 |
| 4,181,069 | 1/1980 | Porter | 493/204 |
| 4,285,681 | 8/1981 | Walitalo et al. | 493/194 |
| 4,292,033 | 9/1981 | Wolske | 493/204 |
| 4,371,365 | 1/1983 | Shingo | 493/204 |
| 4,386,465 | 6/1983 | Ezaki | 83/459 |
| 4,395,252 | 7/1983 | Lemacher | 493/204 |
| 4,451,249 | 5/1984 | DeBin | 493/196 |
| 4,459,172 | 7/1984 | Achelpohl et al. | 493/204 |
| 4,487,599 | 12/1984 | Bendig et al. | 83/171 |

*Primary Examiner*—E. R. Kazenske
*Assistant Examiner*—Hien H. Phan
*Attorney, Agent, or Firm*—Raymond E. Parks; Douglas W. Rudy; Richard B. Megley

[57] ABSTRACT

This application discloses a method and apparatus for converting thermoplastic web material, flat or tubular, to produce bags. A conventional bag machine produces web segments provided with a group of centrally located holes and each segment is transferred by a conventional rotary transfer device to one of a plurality of platforms which are sequentially located at a stacking station. The platforms are provided with upwardly projecting pins on which the web sections are stacked. After the accumulation of a desired number of web segments on the platform located at the stacking station, the loaded platform is indexed away from the stacking station to a perforating station and then to a cutting or cutting and blocking station to thereby produce two bag stacks, each of which are retained on the associated platform by the pins.

14 Claims, 10 Drawing Figures

TWIN WICKETING BAG MACHINE

This is a continuation of application Ser. No. 528,926, filed Sept. 2, 1983, now abandoned.

This invention relates to equipment for converting thermoplastic films and more particularly to converting equipment and that produces thermoplastic bags.

The disclosure of the present application is related to and is an improvement to the subject matter disclosed in U.S. Pat. No. 4,451,249, filed Sept. 21, 1981 and assigned to the assignee of the present application. It is intended that the disclosure of the reference application be incorporated herein.

The mentioned application discloses a bag making procedure in which the elongate strip of thermoplastic web is provided with lines of perforation located centrally of the web strip. Each segment produced by the action of the seal bar contains the centrally located lines of perforation. In transporting the web segment by a rotary transfer device, from the pickup station to the stacking station containing the upwardly projecting pins, partial or full separation along a line of perforation sometimes occurs. If full separation occurs while the web segment is in transit to the stacking station, stacking of that web segment cannot be achieved since registration with the stacking post is no longer possible. In the event partial separation occurs and stacking on the post is achieved a portion of that web segment may not lie in a position to produce a bag stack having the edges of each individual bag overlying each other.

According to the present invention the web segments transferred to the stacking posts are absent of any perforations and thus clearly obviate the problem of premature partial or total tearing along the lines of perforation. In fulfilling this feature the present invention proposes to effect perforation of a complete stack of web segments while they are retained on the stacking posts or pins and subsequently, at an adjacent station, effect cutting of the perforated web segments at an adjacent downstream station.

U.S. Pat. No. 4,451,249 discloses, in FIGS. 9 and 10, a cutting station substantially similar to the cutting station disclosed herein.

FIGS. 1A and 1B, considered together, is a side elevation of a web processing machine constructed and operating in accordance with the principles of the present invention, FIG. 2 is a perspective illustrating the mechanism involved for transferring a web segment from a transfer station to the stacking station, FIG. 3 is a perspective illustrating a stack of web segments deposited on pins carried by a stacking plate, FIG. 4 is similar to FIG. 3 but additionally shows the perforating knives after perforation of the stacked web segments has occurred, FIG. 5 illustrates the web segments being cut between the pins by a knife to produce bag stacks, FIG. 6 is a side elevation of the knife supporting and actuating means, FIG. 7 is a section of FIG. 6 taken substantially along the line 7—7.

FIG. 9 is a side view of FIG. 8 as viewed along the line 9—9.

Figure 1A:
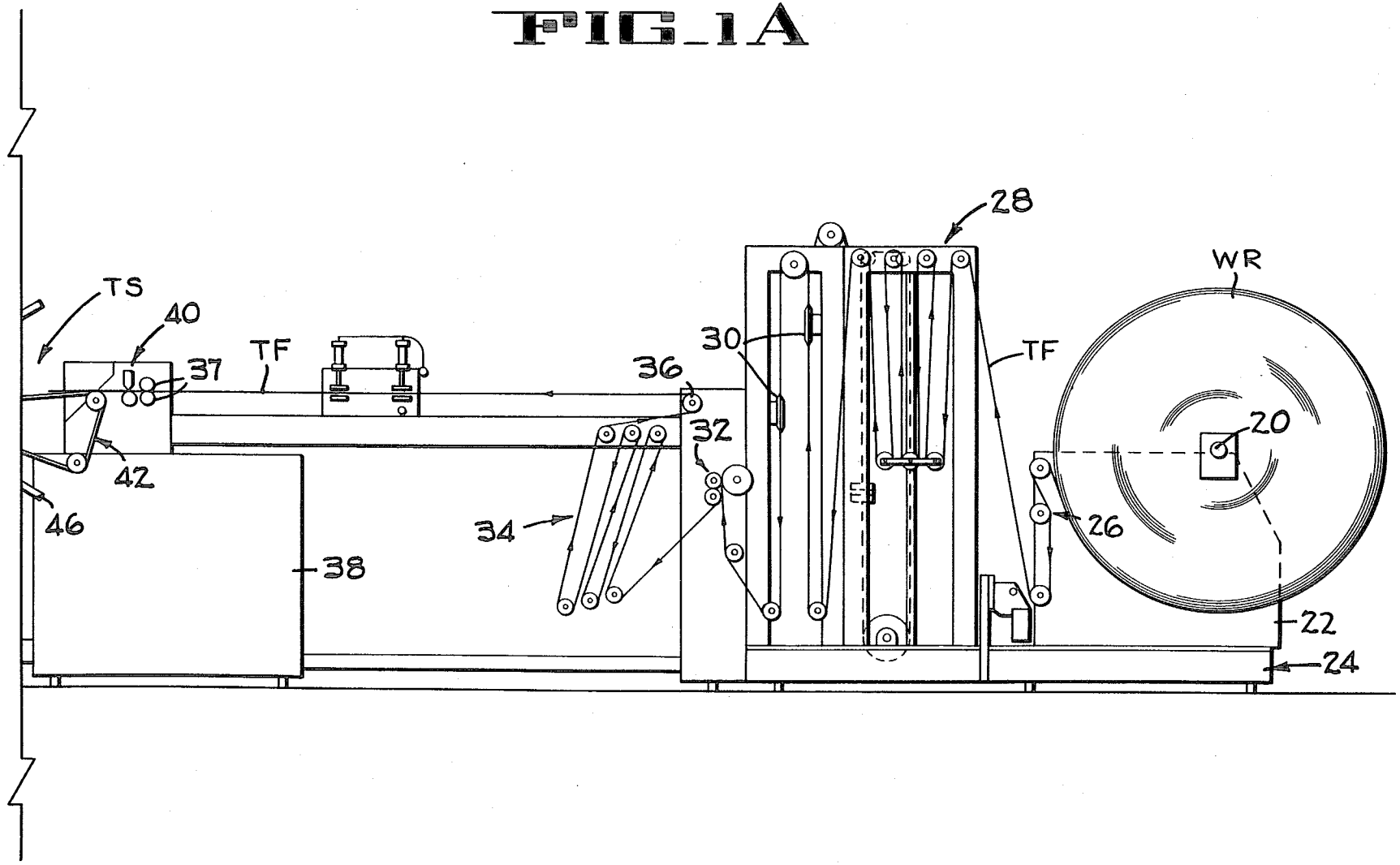

Referring first to FIG. 1A it will be seen that a web roll WR is mounted on a transverse shaft 20 rotatably supported by an unwind stand 22 carried by a frame structure 24. The web strip unwound from the web roll WR passes over a series of rolls collectively identified by the numeral 26 and then progresses over a serial of rolls rotatably mounted in a tower structure 28 which includes gusseting devices 30. Unreeling of the web strip from the web roll is accomplished by drive rolls 32 and thereafter the web is passed over a series of rolls comprising a web tensioning device 34. A turning roll 36 directs the web strip to draw rolls 37 which are intermittently operated by the drive of a bag machine 38.

The thermoplastic film TF is advanced by the draw rolls to a severing and sealing station 40 and the portion of web advanced is momentarily retained on a series of belts 42 generally describing a triangular path and defining a transfer station TS. On creation of a web segment WS located at the transfer station (FIG. 2), a rotary transfer mechanism 44, which includes a plurality of regularly spaced radially extending tubular bars 46, connected through a hub 48 to a source of vacuum, engages and retains a web segment at the transfer station and translates it through an arc for reception by one of a series of stacking devices 50 located at a stacking station 52.

Figure 2:
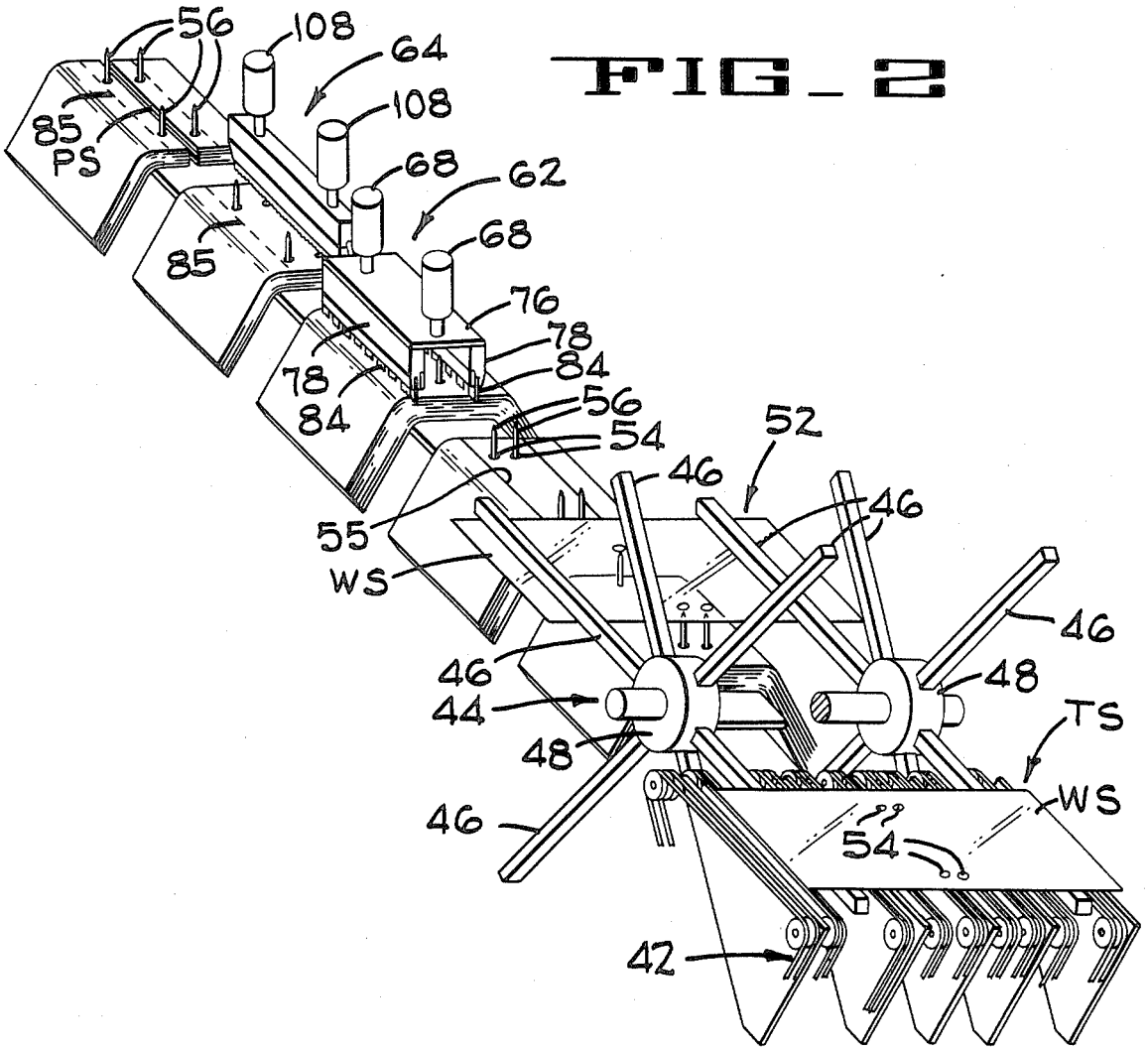

Reference to FIG. 2 will reveal one style of web segment in which each segment has a central medial strip 55 removed from one panel and the remaining panel is provided with four holes 54 through which project stacking pins or posts 56 projecting upwardly and fixed to a base plate of the stacking devices 50. The posts 56 are located to correspond to the spacing of the holes 54 so that each web segment is retained on the stacking devices 50 by the posts 56. During machine operation a selected number of web segments are stacked on the stacking devices 50 and when the predetermined number of web segments has been stacked operation of the bag machine 38 is arrested and concurrently therewith a successive stacking device 50 is positioned at the stacking station 52.

Figure 1B:
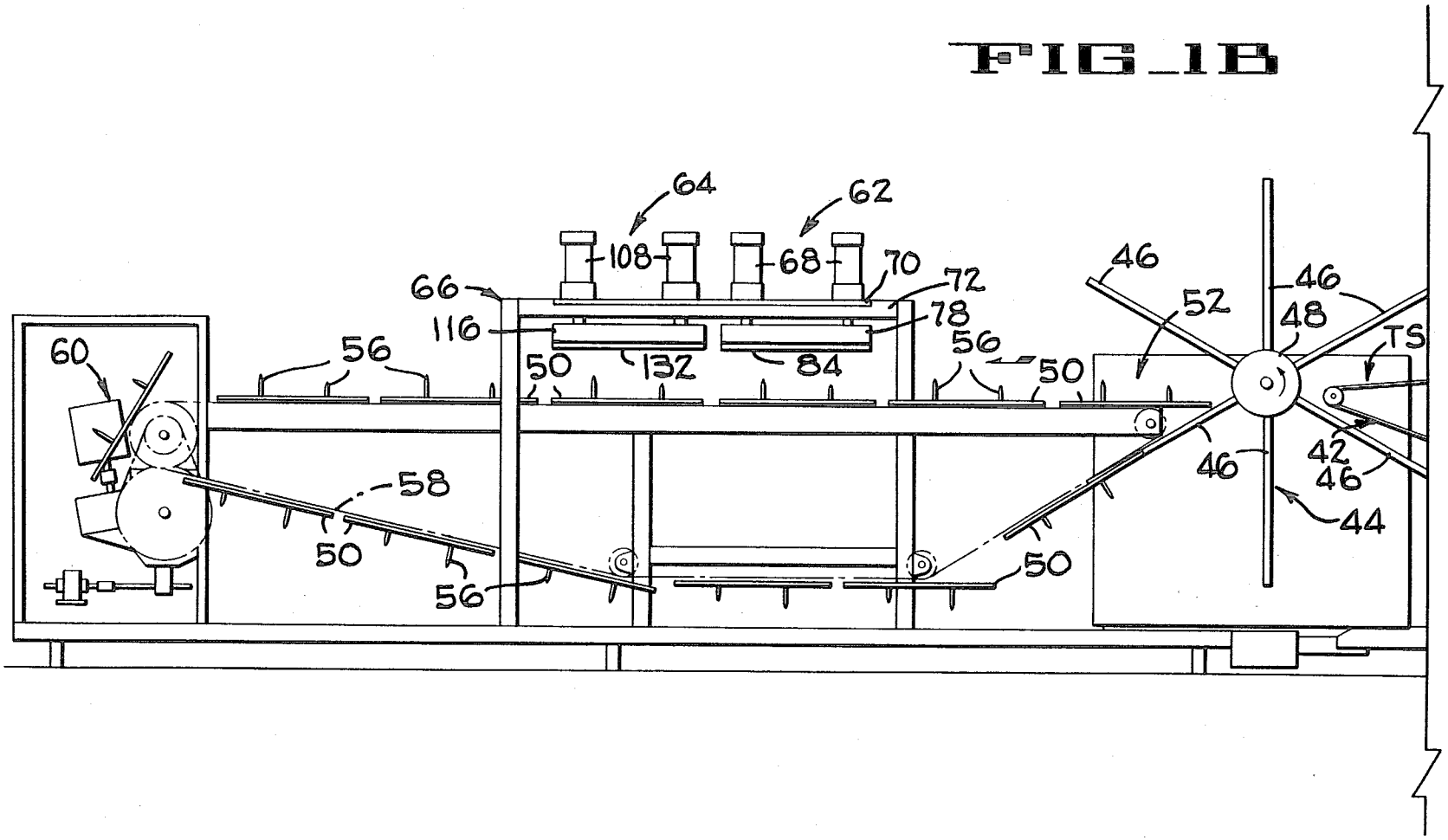

Reference to FIG. 1B will reveal the provision of a conveyor 58 that is intermittently driven by drive mechanism 60 such that the upper reach of the conveyor is incrementally advanced from right to left as viewed in FIG. 1B. Also, as revealed by this Figure, the stacking devices 50 are mounted on the conveyor and successive stacking devices are positioned at the stacking station 52 for a period of time required to accumulate a selected number of web segments.

In accordance with the principal feature of the present invention the problem of premature partial or complete detachment of a portion of a web segment WS, along a line of perforation, does not arise since the web segments produced by the bag machine do not include perforations. Accordingly, forces created by air pressure in the course of transferring a web segment by the transfer device 44 from the transfer station TS to the stacking station 52 is easily tolerated by the web segment. As will be explained presently, the bag stacks produced include perforations but their creation occurs while a stack of web segments is retained on the stacking posts 56 carried by the stacking devices 50.

Further processing of the web segments WS to produce two perforated bag stacks from each group of web segments is achieved by perforating means 62 and cutting means 64 being carried by a frame structure 66 straddling and overlying the conveyor 58. The cutting means 64 are in substantial respects similar to the cutting means disclosed in the above referenced U.S. application Ser. No. 304,405. During the time when a stack of web segments is being accumulated on the stacking device 50 located at the stacking station 52 the conveyor 58 is inactive. During this time period the perforating means 62 and the cutting means 64 are rendered operative, sequentially or concurrently, to effect, respectively, perforation and separation of the accumulated web segments to produce two individual bag stacks each of which contain a line of perforation.

Figure 8:
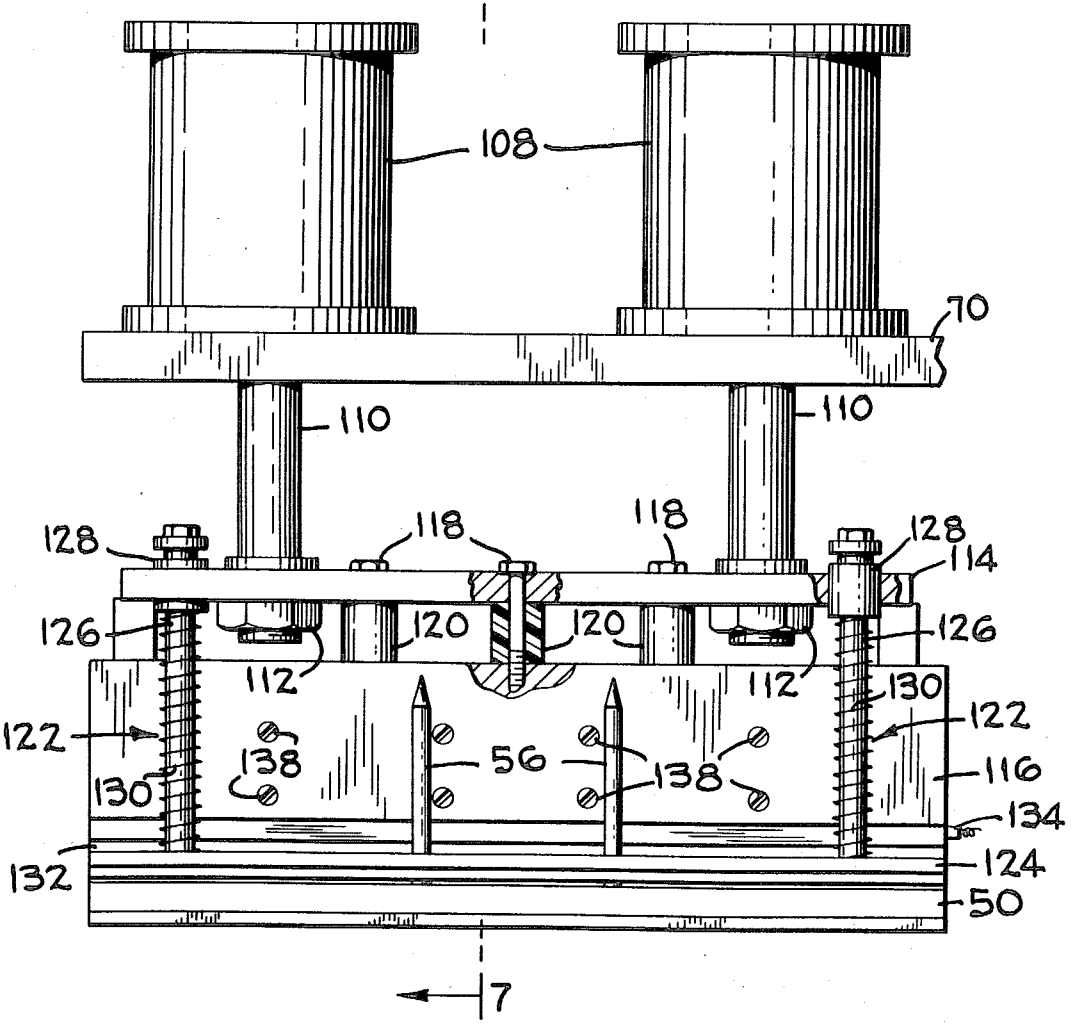
FIG. 8 is an elevation of the perforating mechanism.
Figure 5:
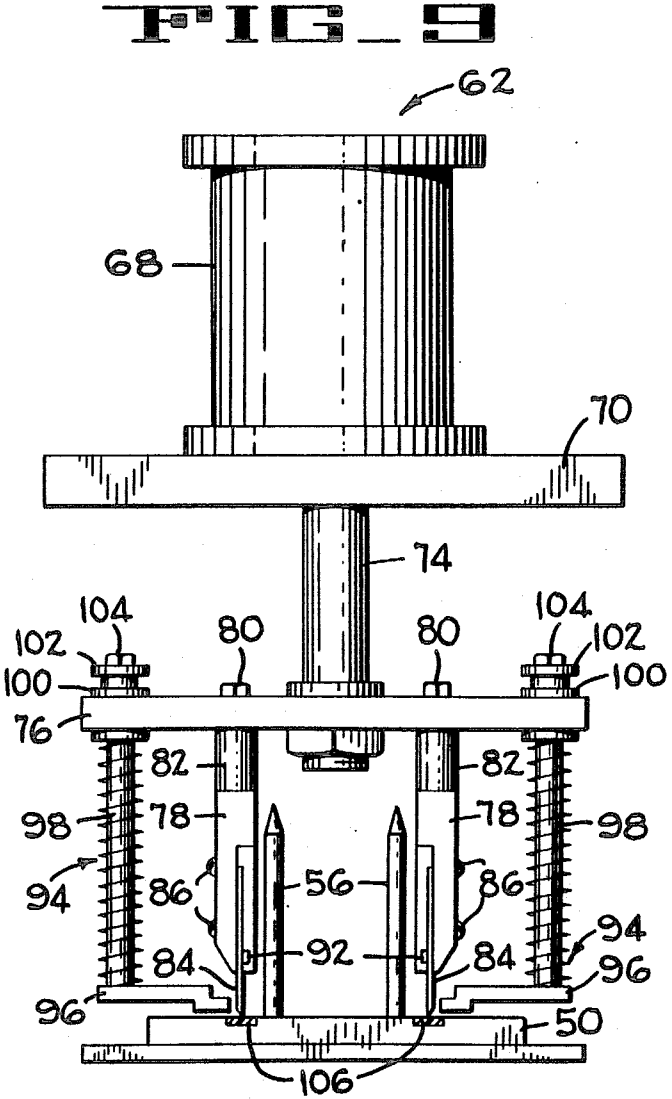
Figure 8:
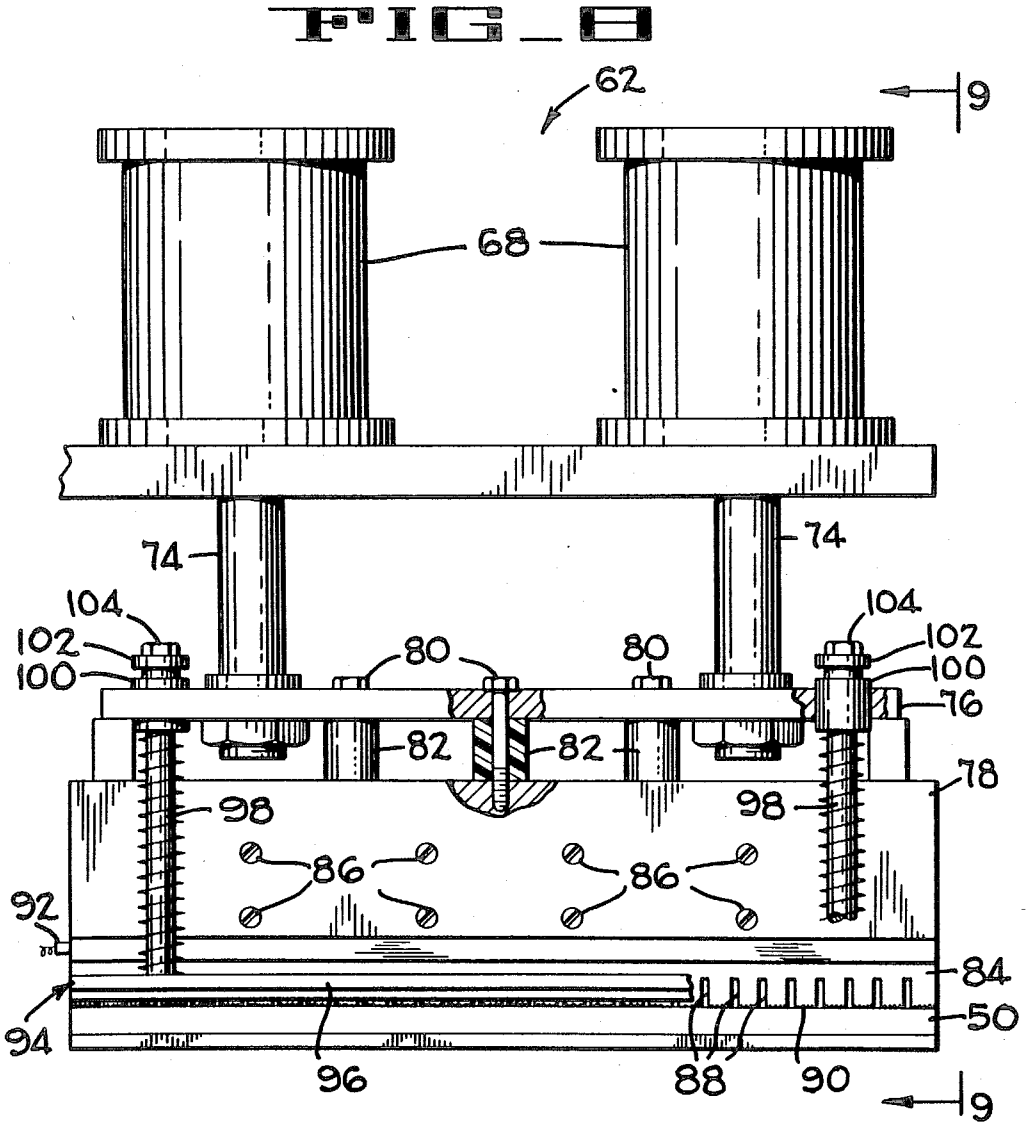

The preferred construction of the perforating means 62 is shown in FIGS. 8 and 9 and comprises linear actuators 68 secured to a flat plate 70 which is in turn adjustably secured to horizontal supports 72 (FIG. 1B) of the frame structure 66. The plate 70 is provided with bores through which extend the rods 74 of the linear actuator 68. The extremity of each rod 74 is fixed to a crosshead 76 carrying downwardly projecting perforating knife holders 78. The knife holders 78 are secured to the crossheads 76 by a series of bolts 80 passing through insulating spacer blocks 82 and threaded into the perforating knife holders 78. Perforating knives 84 are secured to the holders 78 by a series of fasteners 86 and the perforating knives 84 extend beyond the holders 78 sufficient to penetrate a stack of web segments. FIG. 8 shows the general configuration of each of the perforating knives, and it will be seen that each knife is provided with a series of slots 88 creating an interruption in the line of cut defined by a cutting edge 90 which may take the form of a jagged edge which experience has shown requires less force to penetrate each stack of web segments. To enhance penetration of the knife 84 each of the perforating knife holders 78 is provided with a slug heater 92 which can be energized to produce a given temperature to each of the knives 84. Heating of the knives 84 has been found to reduce the amount of force necessary to penetrate a stack of web segments and yet the tendency to form a blocked stack does not arise when a sufficiently low temperature level is selected.

Before the perforating knives 84 make contact with the uppermost web segment of the stack of segments, means 94 are provided for compressing the stack to prevent upward bulging of the stack when the knives 84 come into pressure engagement with the stack. As shown in FIGS. 8 and 9 the compressing means 94 include elongate offset bars 96 which are substantially equal in length to the perforating knives 84 and make contact with the stack adjacent the line of perforation established by the knives 84. The bars 96 are connected to the crosshead 76 by spring biased rods 98 which slidably extend through bushings 100 mounted in the crosshead 76. A stop member 102 is secured to the upper end of the rod 98 by a fastener 104 to limit and retain the rods 98 in the bushings 100.

According to the above described arrangement when the actuator 68 is energized to effect operation of the perforating means 62 the elongate bars 96 come in contact with the stack of web segments forcing them downwardly onto the stacking devices 50 and immediately thereafter the perforating knives 84 penetrate and accordingly perforate the stack of web segments.

In order to enhance the longevity of the knives 84 the stacking devices 50 are provided with inserts 106 which can be made of wood or plastic material which will allow penetration of the knives 84 and yet have a minimal effect in rendering the cutting edge of the knives dull.

Figure 7:
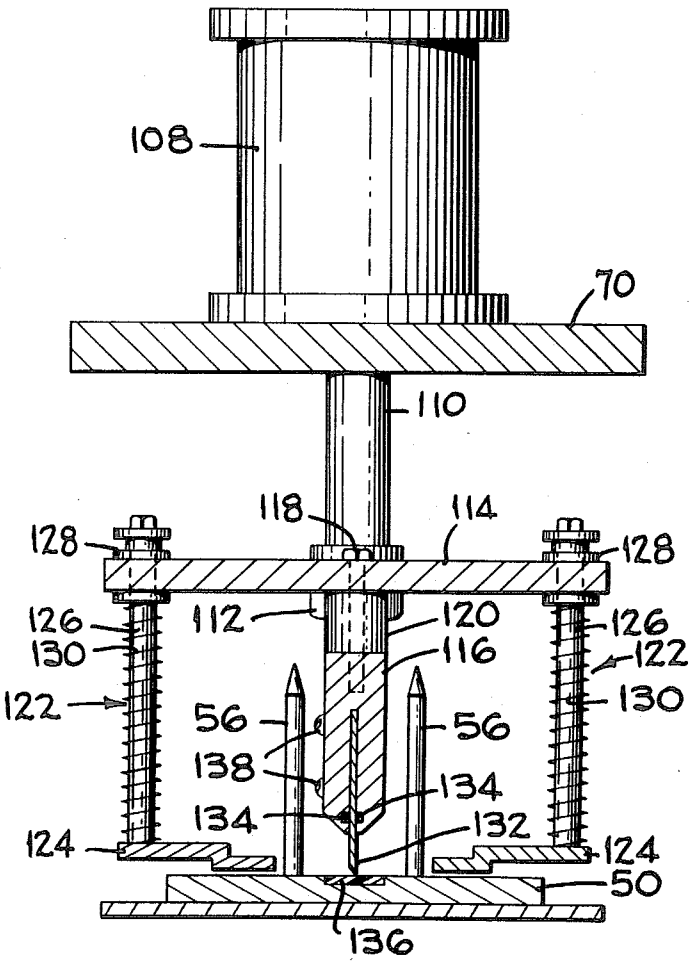

As shown in FIG. 2 the cutting means 64 is located downstream and adjacent the perforating means 62 and if desired the perforating means and the cutting means can be actuated simultaneously or sequentially at the option of the user. FIGS. 6 and 7 illustrate the cutting means 64 in greater detail and it will be seen to comprise linear actuators 108 also mounted on the flat plate 70 being suitably bored to accommodate reciprocating movement of rods 110 having their lower ends threaded to receive a nut 112 fastening the rods to a crosshead 114. A knife holder 116 is in turn connected to the crosshead 114 by bolts 118 extending through insulating spacers 120. In similar respects the cutting means is provided with stack compressing means 122 which include presser bars 124 rigidly connected to rods 126 having their upper ends slidably disposed, by means of bushings 128, to the crosshead 114. Tension springs 130 are associated with each of the rods and serve to bias the presser bars 124 downwardly.

The knife holder 116 is formed to receive and retain a cutting knife 132 and rod heaters 134 serving to heat the knife 132 to a desired temperature to facilitate cutting of the web segments, while they are retained on the pins 56, into two bag stacks each of which include a line of perforation previously made by the perforating means 62. As with the perforating means, cutting means 64 includes, in the stacking device 50, an insert 136 selected of a material such as previously indicated to prevent dulling of the cutting edge of the knife 132. The knife 132 is retained in the holder 116 by a plurality of fasteners 138.

Figure 3:
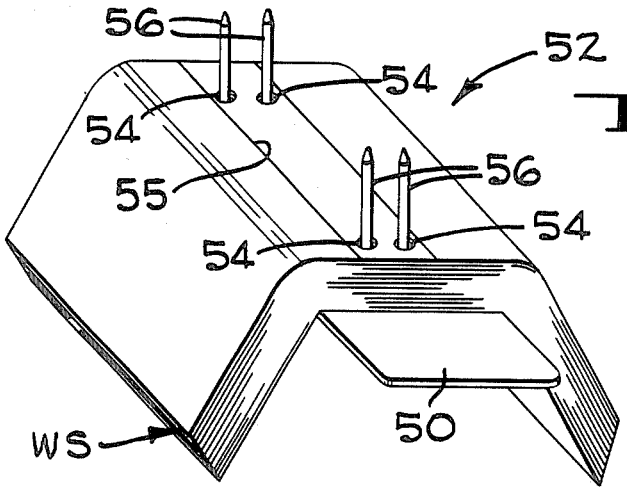
Figure 4:
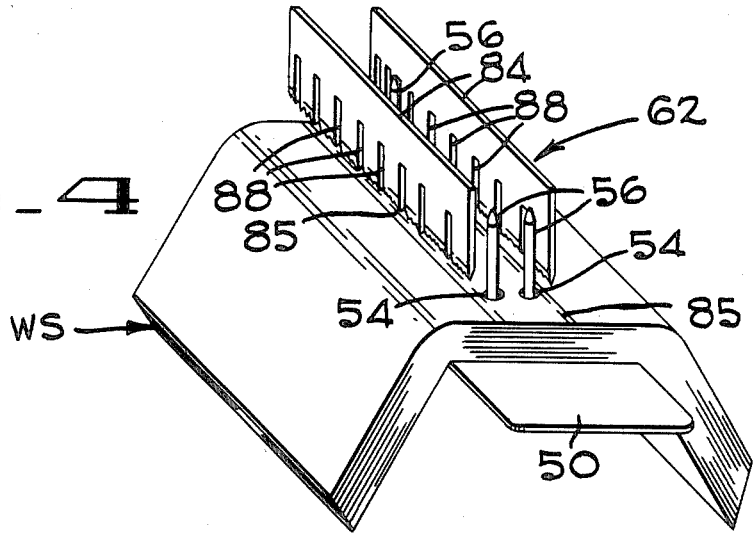
Figure 5:
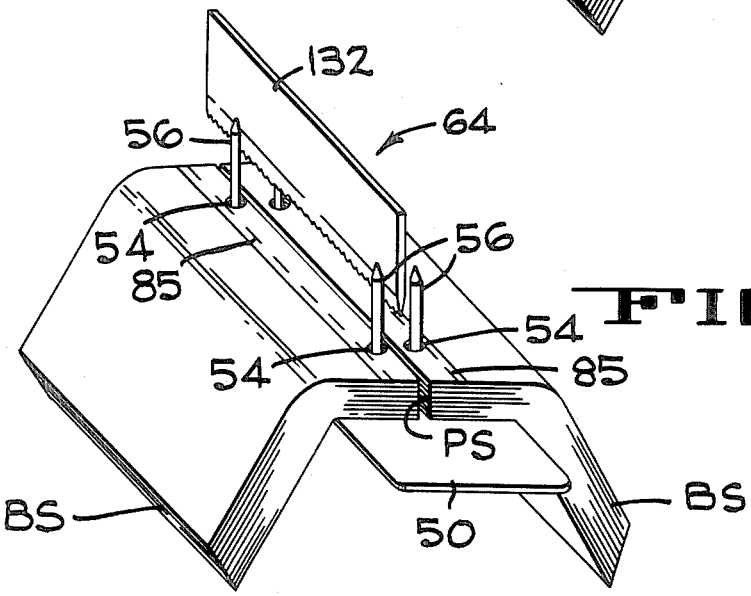

Reference to FIGS. 3, 4 and 5 shows the condition of a stack of web segments at the stacking station 52, the perforating station 62 and the cutting station 64. When the conveyor positions a stack of web segments WS at the perforating station 62 and the actuators 68 are operated to drive the perforating knives 84 to cut the web segments, lines of perforation 85 are produced adjacent the stacking posts 56. As previously mentioned, the cutting station 64, operating the parting knife 132 may be concurrently or subsequently operated to produce two bag stacks BS by cutting the web segments along a line PS, located between the stacking posts 56.

In view of the above described construction of the mode of operation of the over-all machine, and more particularly the perforating means 62 and the cutting means 64, it should be evident that performing the perforating and cutting function after a selected number of web segments have been stacked the problem of the prior art of premature separation along one or more lines of perforation formed in the web segment before stacking does not arise.

What is claimed is:

1. In a bag making apparatus of the type for processing an elongated strip of thermoplastic web material being operative to divide the web into segments of equal dimension and provide each segment with at least two apertures located adjacent to and on either side of in the longitudinal median of each segment, the segments on being produced are transferred to a stacking device provided with stacking posts on which successive segments are stacked on posts projecting through the apertures, the improvement in said apparatus comprising means operative while a stack of segments is retained on said stacking device for producing lines of perforation dividing each segment to define two bags.

2. The bag making apparatus according to claim 1 wherein said stacking devices have mounted thereon a pair of stacking posts located on each side of its longitudinal median and said web segment are provided with apertures conforming in number and spacing to said pair of stacking posts, said perforating means being positioned to produce perforations along lines adjacent said posts.

3. The bag making apparatus according to claim 1 further comprising means for cutting the perforated stack of segments while on said stacking device to produce two discrete bag stacks.

4. A bag making machine having a serrating apparatus for serrating a plurality of previously mechanically manipulated and stacked layers of dual bags made from a thermoplastic web material, the bags having stacking holes, the improvement comprising:

pin means for receiving individual dual bags through the stacking holes therein for stationarily supporting the plurality of layers of dual bags in a stack, manipulating, stacking, and conveying means for conveying the individual dual bags to the pin means, means for serrating the stack of dual bags along spaced parallel lines while disposed on the pin means, means for mounting said serrating means downstream of said manipulating, stacking and conveying means, said mounting means including a holder carrying said serrating means, means connected to said holder for reciprocating said serrating means to penetrate all layers of the stack of dual bags mounted on the pin means to effect the parallel lines of serrations, said reciprocating means being operative to withdraw said serrating means after the serration is effected, means for heating said serrating means to a temperature below the melting temperature of said thermoplastic web material to thereby facilitate penetration of the stack of dual bags without joining the stack of dual bags, said serrating means comprising an elongate flat blade-like member clamped to a recess formed in said holder and provided with a series of slots interrupting the leading sharpened edge thereof to thereby produce a series of incisions and uncut bond portions being sufficiently weak to allow easy separation of individual bags from the stack of dual bags selectively along the parallel lines of serrations.

5. The bag machine according to claim 4 further comprising means carried by said mounting means for compressing said layers of thermoplastic material along a line adjacent the line of perforations, said compressing means operating to engage the thermoplastic material before it is engaged by said perforating means.

6. The bag making machine according to claim 5 further including means for conveying the stack of thermoplastic web material mounted on the pin means from said perforating means to a severing means for severing the stack along a line parallel to and between said pin means and said perforations, into two stacks of perforated bags mounted on the pin means.

7. In a bag making apparatus of the type wherein an elongated strip of thermoplastic web material is processed to produce web segments of equal dimension and wherein the segments, as they are produced, are transferred in an arcuate path in which a stacking plate, mounting upwardly projecting pins penetrate through the medial region of the segments, accumulates a desired quantity of overlapping segments, the improvement in said apparatus comprising means, operable after displacing the stacking plate carrying the desired quantity of accumulated web segments from the arcuate path, for producing two spaced lines of perforations in the medial region of the accumulated segments, said means for producing the lines of perforation dividing each segment into two bags.

8. An improved bag making machine for manufacturing bags from a thermoplastic web material comprising a rotary transfer device for use in grasping and transferring non-perforated web segments successively from a pickup station on to a stacking station, the stacking station including an intermittently operating endless conveyor carrying a plurality of longitudinally spaced apart stacking devices having sets of stacking pins for use in impaling successive non-perforated web segments deposited thereon through complementary holes provided in a median strip of each non-perforated web segment, the conveyor intermittently positioning each successive empty stacking device in the path of the rotary transfer device and concurrently moving the immediate filled stacking device containing a layer of predetermined number of stacked non-perforated web segments impaled on the stacking pins upstream out of the path of the rotary transfer device to a perforating station, the perforating station including a perforating apparatus having a pair of perforating knives positioned above the stacking device filled with non-perforated segments impaled on the stacking pins moved by the conveyor from the stacking station to the perforating station, means for moving the pair of perforating knives downwardly and piercing the layer of stacked web segments and forming two parallel lines of perforations extending longitudinally with respect to the movement of the conveyor and spaced laterally outwardly from the stacking pins and defining a stack of non-severed siamese bags impaled on laterally opposite outward sides of the stacking pins.

9. An improved bag making machine according to claim 8 wherein the perforating station further includes a cutting apparatus having a cutting blade means extending along a median line laterally inwardly of the stacking pins and parallel to the parallel lines of perforations for use in separating the siamese bags into two stacks of bags with each stack of bags impaled on respective stacking pins with the respective lines of perforations of each stack of bags spaced laterally outwardly from the respective stacking pins.

10. An improved bag making machine according to claim 8, and further comprising a cutting station downstream of the perforating station, the cutting station including a cutting apparatus positioned above a stack of perforated siamese bags impaled on the stacking pins delivered thereunder by the conveyor from the perforating station, the cutting apparatus having a cutting knife for use in separating the siamese bags along a median line laterally inwardly of the stacking pins into two stacks of bags with each stack of bags impaled on respective stacking pins and each line of perforation extending parallel to and spaced laterally outwardly from the respective stacking pins.

11. An improved bag making machine according to claim 9 or claim 10, wherein the perforating apparatus comprises two parallel perforating knives having interrupted cutting edges positioned laterally outwardly of the stacking pins, and a means for heating the perforating knives to a temperature below the melting temperature of the thermoplastic web material for facilitating penetration of the interrupted cutting edges through the thermoplastic web material without melting and joining the layer of stacked web segments impaled on the stacking pins.

12. An improved bag making machine according to claim 9 or claim 10, further comprising a resilient pad mounted to each of the stacking devices vertically aligned below the cutting edge of each of the knives for use in protecting the cutting edges of the knives following the penetration of the layer of web material.

13. Bag making apparatus for producing plastic bags from web segments, each web segment of a predetermined size dimensioned to form dual bags for producing two individual bags, said apparatus comprising elongate upstanding members arranged to hold a plurality of layers of non-serrated dual bags made from the web segments as a stack, serrating means for producing two parallel, spaced lines of serrations in the stack of dual bags, characterized in that the serrating means is located so that the serration operation is effected on the stack of dual bags while held in registry by said upstanding members, producing a stack of serrated non-severed dual bags held by said upstanding members; and that there is means operable on each non-serrated dual bag for providing each non-serrated dual bag with at least two apertures located adjacent to and on either side of the median, considered in the longitudinal direction of the web segment, of each formed non-serrated dual bag, each formed apertured and non-serrated dual bag being transferred successively to a stacking device incorporating said upstanding members on which the successive apertured and non-serrated dual bags are collected and stacked in a layer, the upstanding members extending through the apertures in the layer of the stacked non-serrated dual bags.

14. Bag making apparatus for producing plastic bags from web segments, each web segment of a predetermined size dimensioned to form dual bags for producing two individual bags, said apparatus comprising elongate upstanding members arranged to hold a plurality of layers of non-serrated dual bags made from the web segments as a stack, serrating means for producing two parallel, spaced lines of serrations in the stack of dual bags, characterized in that the serrating means is located so that the serration operation is effected on the stack of dual bags while held in registry by said upstanding members, producing a stack of serrated non-severed dual bags held by said upstanding members; and that there is means operable on each non-serrated dual bag for providing each non-serrated dual bag with at least two apertures located adjacent to and on either side of the median, considered in the longitudinal direction of the web segment, of each formed non-serrated dual bag, each formed apertured and non-serrated dual bag being transferred successively to a stacking device incorporating said upstanding members on which the successive apertured and non-serrated dual bags are collected and stacked in a layer, the upstanding members extending through the apertures in the layer of the stacked non-serrated dual bags; and that the serrating means are operative while the stacked layer of non-serrated dual bags is retained on said upstanding members of said stacking device for producing parallel lines of serrations enabling subsequent division of each dual bag along the lines of serrations to define two individual bags.

* * * * *